United States Patent [19]

Crump

[11] Patent Number: 4,735,174

[45] Date of Patent: Apr. 5, 1988

[54] HOT WATER HEATER WITH COUNTERFLOW ACTION

[76] Inventor: Robert F. Crump, 1503 Thackeray Dr., Louisville, Ky. 40205

[21] Appl. No.: 822,844

[22] Filed: Jan. 27, 1986

[51] Int. Cl.[4] ..... F24H 1/00

[52] U.S. Cl. ..... 122/17; 122/156; 122/159; 126/362

[58] Field of Search ..... 122/13 R, 14, 16, 17, 122/135 R, 155 R, 155 F, 156, 159, 160, 161, 165, 183, 45, 48, 118, 332, 333, 321, 322, 504; 126/361, 362; 236/20 R

[56] References Cited

U.S. PATENT DOCUMENTS

| | | | |
|---|---|---|---|
| 1,101,872 | 6/1914 | Meacham | 122/156 |
| 1,552,292 | 9/1925 | Fuller | 122/16 |
| 1,908,149 | 5/1933 | Horton | 122/17 |
| 1,971,139 | 8/1934 | Harris | 122/504 |
| 2,077,323 | 4/1937 | Hendrix | 122/17 |
| 2,561,465 | 7/1951 | Eplins et al. | 122/17 |
| 2,576,603 | 11/1951 | Hines et al. | 122/17 X |
| 2,773,488 | 12/1956 | MacCracken et al. | 122/161 |
| 3,580,224 | 5/1971 | Rouet | 122/16 |
| 4,474,139 | 10/1984 | Dobias | 122/13 R |
| 4,505,231 | 3/1985 | Syles | 122/159 |

*Primary Examiner*—Albert J. Makay
*Assistant Examiner*—Steven E. Warner
*Attorney, Agent, or Firm*—Richard L. Caslin

[57] ABSTRACT

This gas hot water heater has a storage tank with a vertical flue having an elongated tube surrounding the flue to form an inverted inner tank that is closed at its top portion while being open at its bottom portion to the storage tank. A service water inlet pipe is located at the upper portion of the storage tank to discharge cold water into the upper portion of the inner tank to flow in a swirling direction down and around the outside of the flue. This downward swirling action of the cold service water relative to the upward flow of the hot flue gases within the flue tube represents the counterflow action. A thermostatic control valve is located through the wall of the upper portion of the inverted tank so as to open the valve to the inner tank when the water temperature within the inner tank reaches a normal, predetermined high temperature at a stand-by mode when no hot water is being drawn. Hence, the control valve is normally-open during high temperature stand-by conditions. At this point the heating action reverses flow direction by operating as a convection heat exchanger. The heated water rises up through the inner tank, out the control valve and into the outer tank.

9 Claims, 3 Drawing Sheets

FIG. 5
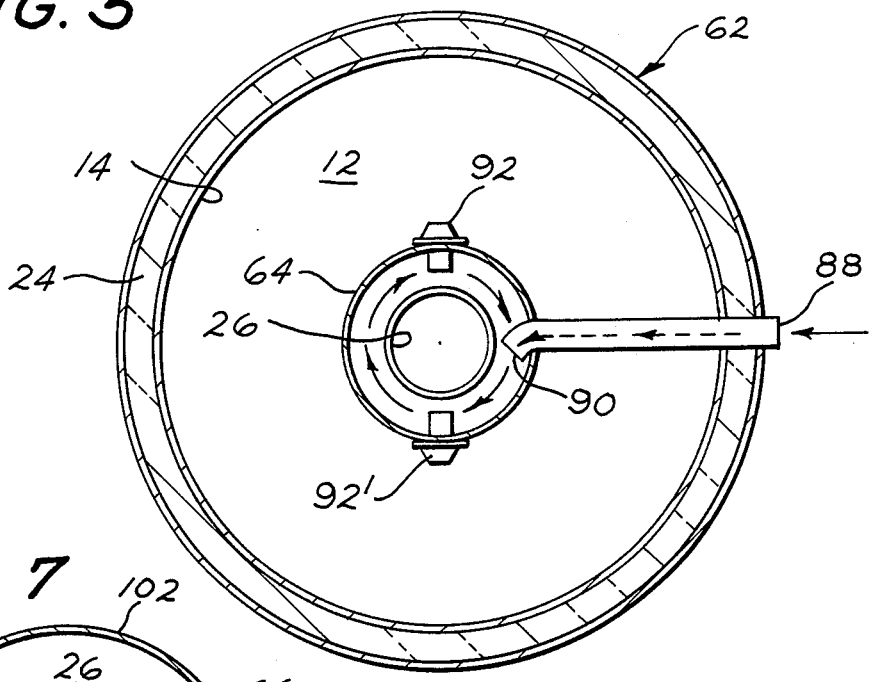
FIG. 7
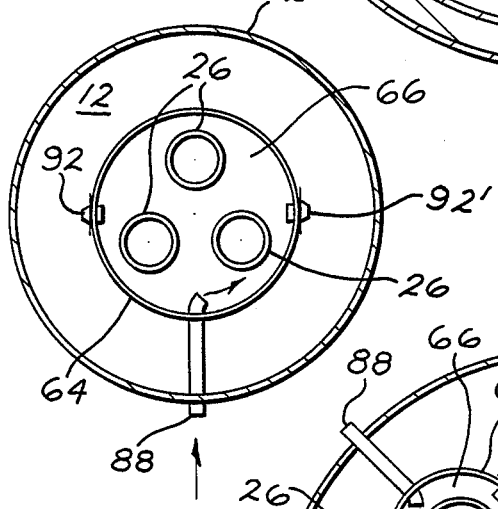
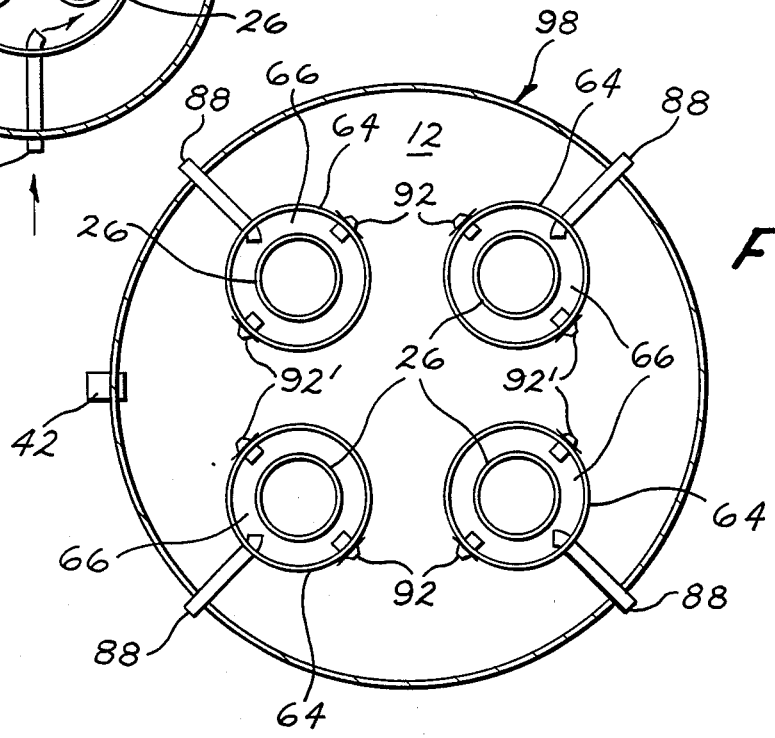
FIG. 6

HOT WATER HEATER WITH COUNTERFLOW ACTION

BACKGROUND OF THE INVENTION

1. Field of the Invention: This invention relates to the art of gas-fired hot water heaters and, particularly, to means for extracting more heat from the central flue pipe before the heat goes up the stack and returns to the atmosphere.

2. Description of the Prior Art: The Rouet et al U.S. Pat. No. 3,580,224 describes a gas hot water heater having a small central pilot flue that is surrounded by a central tank, and it, in turn, is surrounded by an annular flue that is defined between the central tank and the outer tank. The cold water supply pipe discharges into the bottom of the outer tank.

The Fuller U.S. Pat. No. 1,552,292 describes a gas hot water heater having an attachment or percolator that is designed to improve circulation, and it includes a tubular portion that is open at both ends and surrounds the central vertical flue. The cold water intake pipe discharges cold water over the perforated flange fitted over the lower dome that is, in turn, positioned over the gas burner. The circulation of water is then through the holes in the perforated lower flange, and then up through the annular chamber that surrounds the central vertical flue. The hot water spills out over the top edge of this concentric tube.

The Dobias U.S. Pat. No. 4,474,139 describes either a gas or an electric hot water heater that includes a water tank having a jacket which rapidly absorbs heat from and gives up heat to the water, which jacket is an energy saver for the water heater. The jacket is constructed of eight, separate, corrugated cylinders. There is a central pipe extending down through the length thereof. These corrugated cylinders are provided with a large plurality of small openings to render these cylinders porous so that the water will pass therethrough in a somewhat restricted manner.

The Meacham U.S. Pat. No. 1,101,872 describes a small hot water heater having inner and outer shelves that can be readily separated so that the scale deposit from the water can be readily removed from the walls of the inner and outer shelves. The inner casing is corrugated horizontally to form a larger heating surface, thus increasing the heating capacity. The cold water supply pipe is in the lower portion of the heater.

The Syler U.S. Pat. No. 4,505,231 describes a gas hot water heater with sediment removal means. There is a central vertical flue that is vented to the atmosphere. There is an inlet agitator tube that is mounted through the top wall of the tank and extends vertically downward and terminates in a semicircular curved portion that lies in a substantially horizontal plane slightly spaced above the bottom dome. This semicircular curved portion is fitted with a series of inclined openings for directing streams of water against the top surface of the bottom dome each time water is drawn out of the top of the tank. These streams of water serve to agitate the water in the bottom of the tank to prevent the accumulation of sediment therein.

The Epling et al U.S. Pat. No. 2,561,465 describes a water tank having a central vertical flue. In the bottom portion of the tank is a circular deflector plate through which the flue pipe extends. This deflector plate is inclined, and it is provided with diametrically opposed, semicircular cutouts. There is a semicircular hot water tube fastened to the inner surface of the tank and in alignment with the cutout. Several of the modifications of this patent do not employ a flue tube.

The Harris U.S. Pat. No. 1,971,139 describes a gas hot water heater having a central vertical flue. There is a water tube surrounding the vertical flue, and there is also an inert water space within the water tube. Service water is supplied to the service water space by a long vertical pipe that empties near the bottom of the tank. The vented inert water tube that surrounds the vertical flue, and the water head at the bottom of the service water space, which parallels the dome that overlies the gas burner both constitute an indirect heat transfer wall. A circular partition is placed in the inert water space for the purpose of directing circulation by convection upwardly along the outer surface of the vertical flue and downwardly along the inner surface of the water tube. There is an external controller having three separate assemblies; namely, a water valve, a safety valve, and a central cavity that is connected to the inert water space by a horizontal water pipe. However, the inert water tube is not frequently contaminated by infusisons of service water.

The last patent is to Mac Cracken et al U.S. Pat. No. 2,773,488, which describes a boiler-burner unit, where water is brought into the outer jacket from a circulating pump through a curved T-fitting. There is a high velocity burner mounted at the top of the insulated cover. The boiler is made up of two, similar, coaxially arranged envelope sections, where one is disposed within the other.

OBJECTS OF THE PRESENT INVENTION

The principal object of the present invention is to provide a gas hot water heater with an inverted inner tank surrounding the flue so that cold service water enters the top portion of the inner tank and flows downwardly around the hot flue tube in a counterflow action. Later, the heated water in the bottom of the tank rises up the inner tank and opens thermostatic control valve means located in the top of the inner tank and empties into the outer tank to reverse the heating action.

A further object of the present invention is to provide a water heater of the class described with thermostatic control valve means at the upper end of the inner tank to the outer tank to open the inner tank when the temperature within the upper portion of the inner tank reaches a normal, predetermined high temperature, as during a stand-by mode, then the heating action operates as a convection heat exchanger.

SUMMARY OF THE INVENTION

The present invention provides a gas hot water heater having a vertical flue with an inverted inner tank surrounding the flue, where the inner tank is closed at the top portion and open at the bottom portion to the storage tank. A service water inlet pipe is located in the upper portion of the storage tank and discharges cold water into the upper end of the inner tank to flow down and around the flue in a counterflow action. The heated water outlet is located in the top portion of the supply tank of the heater. A thermostatic control valve is located through the wall of the upper portion of the inner tank so as to open the upper end of the inner tank when the water temperature within the inner tank reaches a predetermined high temperature, as during a stand-by mode, and to close the upper end of the inner tank while the cold service water is pouring into the top of the inner tank as it is refilling the storage tank.

BRIEF DESCRIPTION OF THE DRAWINGS

This invention will be better understood from the following description taken in conjunction with the accompanying drawings, and its scope will be pointed out in the appended claims.

FIG. 5 is a transverse, cross-sectional, plan view of the hot water heater of the present invention taken on the Line 5—5 of FIG. 4 to show the nature of the cold service water inlet pipe at the top of the heater, as well as a pair of thermostatically controlled valves mounted through the wall of the elongated tube that surrounds the vertical flue.

FIG. 6 is a transverse, cross-sectional, plan view, on a reduced scale, of another modification of the present invention installed in a commercial gas-fired water heater having a plurality of vertical flues.

FIG. 7 is a schematic, transverse, cross-sectional, plan view, on a reduced scale, of another modification of the present invention used in a commercial water heater where a plurality of vertical flues are bunched together, near the center of the storage tank, and a single tube surrounds this plurality of flues to form an inner tank.

DESCRIPTION OF THE PREFERRED EMBODIMENTS

Figure 1:
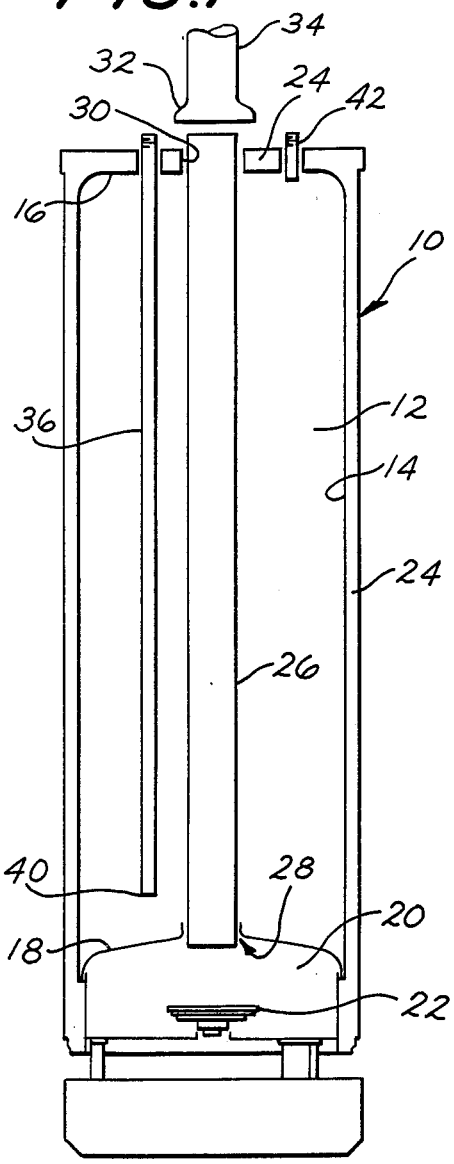
FIG. 1 is a vertical, cross-sectional, elevational view of a conventional, prior art, gas hot water heater having a central vertical flue.

Turning now to a consideration of the drawings and, in particular, to the vertical, cross-sectional, elevational view of a conventional, prior art, gas hot water heater 10, as shown in schematic in FIG. 1, there is a watertight storage tank 12 having a vertical cylindrical tank wall 14 that is sealed at the top end by a top head member 16 and at the bottom by a bottom head member 18. The top and bottom head members 16 and 18 are sealed to the tank wall 14 by any suitable means, such as welding, to form a watertight storage tank 12. Notice the bottom head member 18 is concave downwardly and overlies the combustion chamber 20, which includes the gas burner 22. The storage tank 12 is covered by a layer of thermal insulation 24, which is better illustrated in the larger view of FIG. 4. The products of combustion from the gas burner 22 pass upwardly through a centrally located flue tube 26, which is supported in an opening 28 in the bottom head member 18. This flue tube 26 extends upwardly through an opening 30 in the top portion of the water heater 10, and it is vented to the atmosphere by a vent means 32 that includes a duct 34 external of the water heater 10 that is connected to the chimney (not shown). A vertical cold service water inlet pipe 36 enters the storage tank through a top opening 38 in the water heater, and the discharge end 40 of this inlet is closely spaced from the bottom head member 18. The hot water outlet 42 extends through the top portion of the water heater 10.

Figure 2:
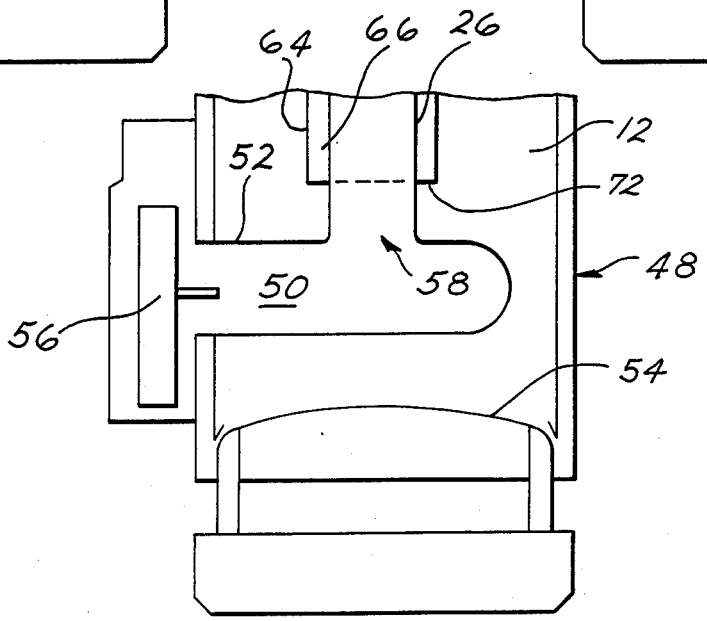
FIG. 2 is a fragmentary, vertical, cross-sectional, elevational view of the lower portion only of a higher efficiency gas combustion chamber, where the chamber is completely surrounded by water in the supply tank for a more efficient use of energy, but where this design also employs a central vertical flue.

Turning now to a consideration of another type of conventional gas water heater 48, as shown in the fragmentary view of FIG. 2, the main difference in this improved burner system is the combustion chamber 50 that is formed of a small cylindrical shape having walls 52. This combustion chamber 50 is arranged horizontally in the bottom portion of the water heater 48, above the bottom head member 54, so that this combustion chamber is completely surrounded by water within the watertight storage tank 12. The actual gas burner 56 is arranged at the left side of the combustion chamber, and most of the heater controls are arranged nearby. Notice, that built into the top wall of the combustion chamber 50 is an opening 58 in which is supported the lower end of the flue tube 26. This improved combustion chamber design effectively transfers heat to the water from all sides and bottom of the combustion chamber which improves the efficiency of this water heater. It is available from the A. O. Smith Corporation.

One reason for mentioning both of the two conventional, prior art, gas water heater designs of FIGS. 1 and 2 is to lay the background for the invention now to be disclosed. The present invention can be incorporated in either one of these conventional, prior art, water heater designs of FIGS. 1 and 2. In addition, the present invention could be incorporated with man other available gas water heater designs, as will be understood by those skilled in this art.

Figure 3:
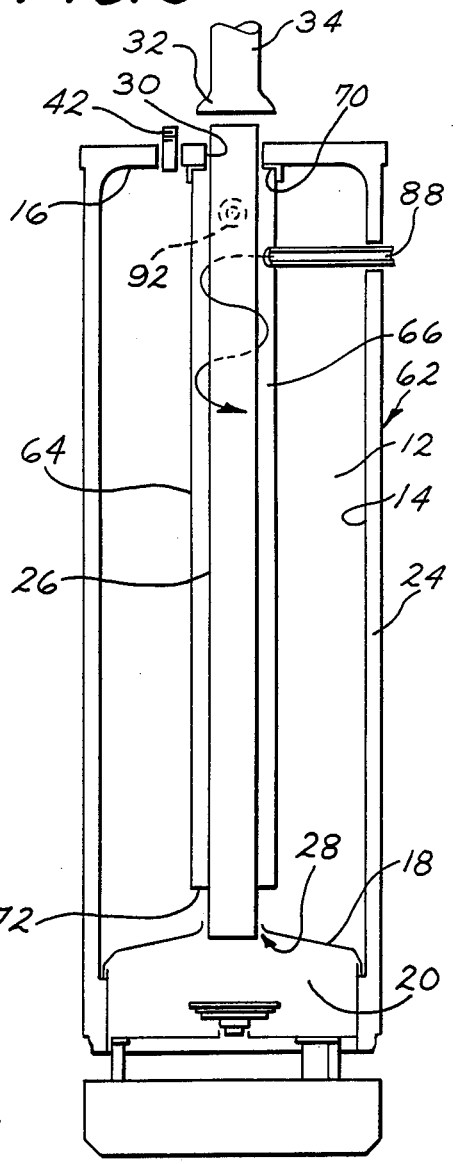
FIG. 3 is a vertical, cross-sectional, elevational view of a gas hot water heater, similar to the conventional heater of FIG. 1, but with the present invention incorporated therewith, and modifications made to accommodate the same.
Figure 4:
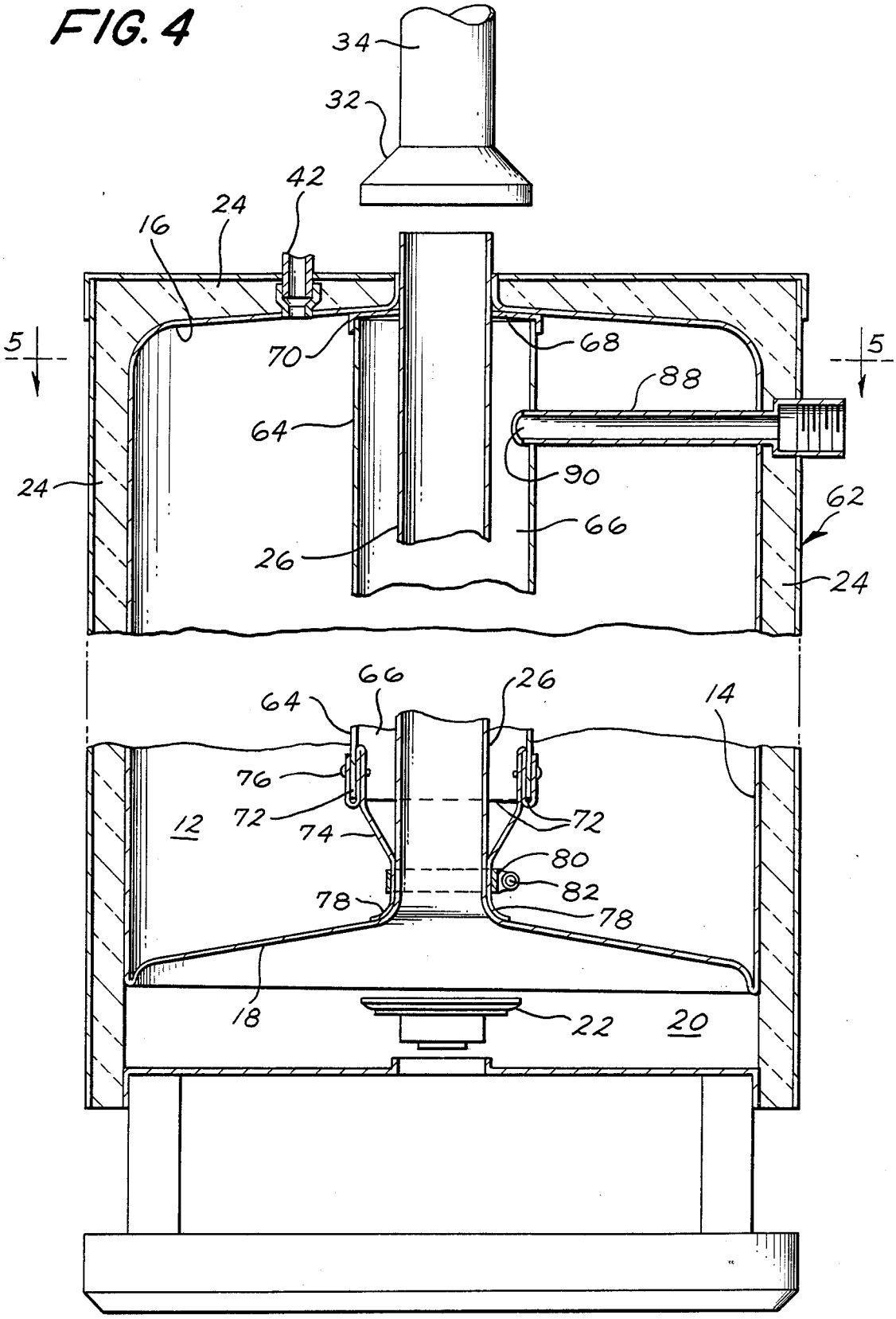
FIG. 4 is a fragmentary, cross-sectional, elevational view similar to that of FIG. 3, but on an enlarged scale, and showing in greater detail the design features at the upper end of the water heater, and also at the lower portion of the water heater.

Now, attention will be directed to FIGS. 3 and 4, which clearly depict the present invention incorporated in the gas water heater 62. The same elements found in FIGS. 3 and 4 which have already been described with relation to the conventional, prior art, water heater 10 of FIG. 1, will be given the same reference numeral. The construction of the watertight storage tank 12 is basically the same, having the tank walls 14 closed by the top and bottom head members 16 and 18 respectively. The vertical flue pipe 26 is also supported from the bottom head member 18 to carry off the products of combustion from the combustion chamber 20.

The present invention includes the introduction of an elongated tube 64 to surround the vertical flue tube 26 for nearly its entire length to form an inverted inner tank 66 that is closed at its top end 68 by a top cap 70, as is best seen in FIG. 4. This top cap 70 has a central opening for receiving the vertical flue tube 26 therethrough. The function of this top cap 70 is also to support the top end of the tube 64 from the flue tube 26 in a generally concentric manner. Still looking at FIG. 4, the bottom end 72 of the surrounding tube 64 is open to the interior of the storage tank 12. The support for the bottom end 72 of the concentric tube 64 comprises a plurality of spring clips 74, which may be three or four in number. These clips are simply narrow straps of metal or plastic which are bent to fold under the lower edge of the bottom end 72 and to be fitted with a fastening screw 76 to join the clip to the tube 64. The lower end 78 of the strap extends inwardly from the concentric tube 64 to engage against the side of the vertical flue tube 26. When all of these spring clips 74 are in place, a hose clamp 80 is used to gather the lower ends 78 of the spring clips against the flue tube 26 and to be clamped in place by the usual fastening screw 82. Thus, most of the vertical support for this surrounding tube 64 is by way of the plurality of spring clips 74 at the bottom of the tube 64, which are bound together by the hose clamp 80. This surrounding tube 64 may be of thin metal construction, or it could be of plastic; just so long as it is able to withstand the temperatures expected to be encountered in the particular hot water heater 62. The closed top end 68 of the surrounding tube 64 is braced against the underside of the top head member 16, and this completes the general nature of the inve ted inner tank 66 that has been installed around the vertical flue tube 26.

The hot water outlet 42 through the top wall of the heater 62 remains the same as in the conventional heater 10 of FIG. 1. However, a major change has been made in the introduction of the cold service water inlet. This invention employs a cold service water inlet pipe 88, which is horizontally disposed at the top of the storage tank 12 in a generally horizontal position, and its discharge end 90 empties into the inner tank 66, as is best seen in the cross-sectional plan view of FIG. 5. This discharge end 90 of the water inlet is angled slightly to swirl the water down and around the exterior of the vertical flue tube 26 in a counterflow action relative to the upward flow of the hot flue gases within the flue tube. The direction of this swirl will depend on the location of the water heater relative to the equator, whether it is in the north hemisphere or the south hemisphere, but this is more a detail rather than a critical element of the present invention.

Another important element of the present invention is the use of a thermostatic control valve 92 that is installed through the wall of the surrounding tube 64, generally above the cold service water inlet pipe 88, as is seen in dotted lines in FIG. 3. Only one of these thermostatic valves 92 is needed, but they are so inexpensive that a second redundant valve 92' is installed in the tube 64, generally across from the first valve 92, as is best seen in FIG. 5. The thought here is to lengthen the useful life of the water heater 62 without the need of maintenance, service, or replacement of parts over many long years. These thermostatic control valves 92 and 92' are normally-open when the temperature of the water within the upper end of the inner tank 66 reaches a temperature somewhere between about 120° F. and 190° F., which is selected by the manufacturer at a preferred level for normal stand-by condition when no hot water is being drawn from the system.

If the water heater is on stand-by and has not been called upon to deliver hot water for a long period of time, the temperature of the water within the storage tank 12 is generally uniform. As the hot water is being withdrawn from the storage tank, the cold service water inlet is directly connected to the city water supply and it automatically replenishes the amount of water taken so as to refill the tank. In the practice of the present invention, this cold service water from the water inlet 88 is forced to swirl down and around the outside of the hot flue tube 26 to be warmed thereby. This warmed water is forced to the bottom of the tank to be further heated by the combustion chamber 20.

After the hot water demand ceases, the cold service water no longer enters the inner tank. Water left in the inner tank will rapidly warm and cause the thermostatic valve to open; whereupon, the water in the inner tank will reverse flow to discharge through the valve at the top of the inner tank and into the outer supply tank by normal convection. This convection action will continue until the setting of the thermostat control (not shown) for the water heater is satisfied and shuts off the gas to the burner. This convection action will continue at a much slower rate so long as the residual heat and pilot heat cause the flue tube to be warmer than the water adjacent to the flue tube.

If only a small amount of hot water is drawn from the outlet 42, the make-up water within the storage tank 12 is efficiently heated by the upper section of the flue tube 26 as well as the wall of the surrounding tube 64 forming this inner tank 66.

If a large amount of hot water is drawn from the storage tank 12, the hot surfaces of the vertical flue 26 and the bottom head member 18, overlying the combustion chamber 20, will heat the cold make-up or service water. The entrance of this large amount of cold make-up water will cause the two control valves 92 and 92' to close. When the water temperature within the inner tank 66 reaches the predetermined temperature setting of the thermostatic control valve 92 and/or the predetermined temperature of the redundant thermostatic valve 92', this, or these, control valves will open, and the circulation of the water within the inner tank 66 reverses and heated water within the inner tank will empty out of the top of the inner tank and into the outer storage tank by convection. The thermostatic valves 92 and 92' will remain closed as long as the cold water enters the inner tank 66 through the discharge end 90.

When the thermostat control of the water heater (not shown) calls for heat, the hottest metal will be the bottom of the tank 18. The flue 26 will be almost as hot as the bottom of the tank and progressively less hot at the top.

By allowing the cold service water to first make contact at the top of the flue 26, as shown in FIG. 3, and discharge at the bottom wall of the tank 18, less lime will be deposited on the flue and bottom wall, while the heat transfer will be maximized.

When several gallons or more of water enter the top of the inner tank 66, the swirling counterflow action will continue even at the bottom of the tank 18. This action helps to hold the lime in suspension. Some of this lime will leave the tank with the hot water and, therefore, reduce the accumulation of lime.

A reduction in liming will allow the system to operate more efficiently and also increase tank life.

In the event the thermostatic control valve 92 or 92' were to fail in a closed position and not be able to open, the present invention would be inoperable. One solution is to mount the valve in the opening in the surrounding tube 64 by means of spring-biasing shoulder bolts such that the outer mounting flange of the valve is allowed to move away from the wall of the tube 64 due to the presence of over-pressure conditions within the inner tank.

Early failures of the conventional hot water heater 10 of FIG. 1 mainly occur due to rupture of the lower end of the storage tank 12 in the vicinity of the bottom head member 18. This early failure is often created by the introduction of the cold service water through the elongated vertical inlet pipe 36 which discharges near the bottom head member 18 which forms the top wall of the combustion chamber 20. This bottom head member 18 is very hot, and it is adjacent to the cold water being discharged into the bottom of the storage tank 12. This causes thermal shock fractures in the porcelain coating that lines the interior surface of the storage tank 12, thus leading to early tank corrosion and eventual failure. In other words, the greatest formation of lime on the tank surfaces occurs where the water is the coldest and the metal is the hottest. In the conventional heater design 10 of FIG. 1, maximum liming takes place on the top surface of the bottom head member 18. This formation of lime creates an insulation which reduces the heat transfer efficiency and causes the temperature of the flue gases exhausting from the flue 26 to rise. This lowers the thermal efficiency of the system.

Turning back briefly to FIG. 2, the present invention could be installed on this model of conventional water heater 48, and this is made clear by the illustration of the lower end 72 of the elongated tube 64 to create the inverted inner tank 66.

As will be understood by those skilled in this art, the present invention could be incorporated into commercial hot water heaters, and one example is given in the transverse, cross-sectional, plan view of FIG. 6, that is shown on a reduced scale. This modified version of the present invention shows a commercial hot water heater 98 of much larger size in diameter than the residential water heater 62 shown in FIG. 5. In this commercial heater 98 the storage tank 12 supports a plurality of vertical flue tubes 26 to take care of a large volume of flue gases emanating from the combustion chamber (not shown). The present invention could be employed in this commercial heater 98 by installing the surrounding tube 64 around each flue tube 26 to form the inverted inner tank 66. The hot water outlet 42 is shown coming out of the side of the heater, and this would be near the top portion of the heater. Each inner tank 66 would be supplied with its own cold service water inlet pipe 88. Notice also that the thermostatic control valve 92 and the redundant valve 92' are also carried over from the invention as used in the residential heater 62 of FIG. 5.

If this commercial heater 98 were being used in a cold climate where the temperature of a cold water supply was very low, it might be decided that some of the vertical flue tubes 26 would be unjacketed; that is, free of the inner tank 66 so as to ensure that the low temperature of the cold water would not lower the temperature of the flue gases to such a degree as to interfere with the proper operation of the combustion system.

Another modification of the present invention is illustrated in the transverse, cross-sectional, plan view of FIG. 7 which shows a commercial water heater 102 having a plurality of vertical flue tubes 26 that are grouped together near the center of the storage tank 12 and surrounded by a single, larger, elongated tube 64 to create a single inner tank 66 to accommodate all three of the flue tubes 26. Again, the cold water inlet 88 discharges into the inner tank 66 and the two thermostatic control valves 92 and 92' are being used.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. In a gas hot water heater including a watertight tank means adapted to contain water under pressure, said tank means including a tank wall and a top and a bottom head member, a source of heat for heating the water inside said tank means and furnished with a vertical flue means that discharges out the top of the water heater; the invention comprising:

a. a generally concentric tube surrounding the vertical flue means for nearly its entire length and supported therefrom, said concentric tube being closed at the top end and open at the bottom end to the tank means to form an inverted inner tank;

b. cold service water inlet means located in the top portion of the tank means and discharging into the top portion of the inner tank so the water swirls down and around the flue means;

c. hot water outlet means located in the top portion of the tank means for withdrawing hot water from the tank means; and d. thermostatic control valve means supported in the sidewall of the top portion of the concentric tube and being normally closed when the tank means is being replenished with cold water;

e. whereby a counterflow heating action is established in the area bounded by the vertical flue means and its concentric tube so the cold water gains greater heat absorption from the vertical flue means;

f. so that when the temperature of the water within the inner tank reaches a predetermined high temperature at normal stand-by condition, the thermostatic control valve means will open and heated water within the inner tank empties into the top portion of the tank means by convection.

2. The invention as recited in claim 1 wherein the said concentric tube forms an inner tank which circumscribes the vertical flue means and is open to the tank means at the bottom of the inner tank, while the top of the inner tank is closed from the tank means except for the normally-closed thermostatic control means that is set to open at a temperature between about 120° F. and 19° F. when the water heater assumes a stand-by mode of operation.

3. The invention as recited in claim 1 wherein the said cold service water inlet means is directed generally horizontally to swirl the incoming water around the exterior of the vertical flue means as it flows downwardly.

4. The invention as recited in claim 1 wherein the concentric tube is fitted with a top cap that both closes the top portion of the concentric tube and supports this top portion from the vertical flue means, while the bottom end of the concentric tube is provided with a plurality of spaced fastener means that are joined to the bottom end of the vertical flue means.

5. The invention as recited in claim 1 wherein the said normally-closed thermostatic control valve means is installed in duplicate in the sidewall of the top portion of the concentric tube at a level above the cold service water inlet means.

6. A gas hot water heater comprising, a. a watertight storage tank means having a tank wall and top and bottom head members, a source of gas heat for heating the water within the storage tank, and having a vertical flue means that discharges out the top of the water heater; the invention comprising the use of an elongated tube surrounding the vertical flue means for nearly its entire length to form an inverted inner tank that is closed at its top portion while being open at its bottom portion to the storage tank;

b. cold service water inlet means located in the upper portion of the storage tank to discharge make-up water into the inner tank to swirl down and around the flue means;

c. hot water outlet means located in the top portion of the supply tank for withdrawing hot water therefrom;

d. normally-closed thermostatic control valve means when exposed to cool temperatures, said valve means being locted through the sidewall of the upper portion of the elongated tube and capable of opening the upper end of the inverted inner tank to the storage tank when the water temperature within the inner tank reaches a predetermined high temperature at stand-up conditions;

e. whereby a counterflow heating action is established within the inner tank after hot water has been withdrawn from the storage tank with cold service water flowing down the inner tank and around the flue means while the hot flue gases rise upwardly through the flue means so the cold service water gains greater heat absorption from the flue.

7. The invention as recited in claim 6 wherein the elongated tube is fitted with a top cap that closes the top end of the tube and supports this top end from the flue means, the bottom end of the elongated tube having fastener means joined to the flue means for holding the tube in place.

8. The invention as recited in claim 7 wherein the said cold service water inlet means is directed generally horizontally to discharge a swirling flow around the exterior of the flue means.

9. The invention as recited in claim 8 wherein the said normally-closed thermostatic control valve means is installed in duplicate through the sidewalls of the top portion of the elongated tube at a level above the service water inlet means.

* * * * *